United States Patent [19]

Oprean et al.

[11] 4,302,007

[45] Nov. 24, 1981

[54] SWIMMER'S DRAG PRODUCING BELT

[76] Inventors: George Oprean, 26 Chili Ave., Scottsville, N.Y. 14546; James E. Counsilman, 2606 E. Second St., Bloomington, Ind. 47401

[21] Appl. No.: 4,902

[22] Filed: Jan. 19, 1979

[51] Int. Cl.[3] ..... A63B 21/26

[52] U.S. Cl. ..... 272/116; 272/71

[58] Field of Search ..... 272/71, 1 B, 116, 119; 9/301, 310 J; 35/29 B; 273/DIG. 19, DIG. 30; 224/224, 226, 239

[56] References Cited

U.S. PATENT DOCUMENTS

| | | | |
|---|---|---|---|
| 2,592,087 | 4/1952 | Wallace | 224/226 |
| 4,071,236 | 1/1978 | Oprean | 272/116 |
| 4,074,904 | 2/1978 | Arcidiacono | 272/116 |

*Primary Examiner*—Richard C. Pinkham
*Assistant Examiner*—Arnold W. Kramer
*Attorney, Agent, or Firm*—Bruns & Jenney

[57] ABSTRACT

A training device for competitive swimmers in the form of a drag producing belt adapted to be worn over the swimmer's regular suit or trunks. The drag producing belt adds weight and increases the resistance (drag) to the swimmer's movement through the water and thus helps in the development of the swimming muscles. The increased drag is caused by normally open ended pockets that are secured to the belt in such a manner that they act as scoops as the swimmer moves through the water. Water entering the pockets is impeded in flowing through them whereby the drag is created. The pockets are located on the belt so that the drag is distributed evenly on the swimmer with no imbalance tending to cause the swimmer to roll or dip.

3 Claims, 6 Drawing Figures

SWIMMER'S DRAG PRODUCING BELT

BACKGROUND OF THE INVENTION

This invention relates generally to athletic training devices, and has particular reference to a novel drag producing belt for swimmers training for competition.

In training competitive swimmers, it has been recognized that the development of the swimming muscles ranks in importance with the swimmer's technique and wind conditioning. One method of development that has been advocated is weight lifting but this is not completely satisfactory because the muscular development does not really correspond to that required for swimming. At the present time, many coaches believe that a more appropriate way to develop swimming muscles is to increase the weight that the swimmer must carry and/or the resistance to his movement through the water while actually swimming laps during training. This strengthens the swimming muscles and the swimmer's endurance and thus improves his competitive ability.

Heretofore, swimmers have added weight and increased drag during practice sessions by wearing several T-shirts and shorts or cut off jeans over their regular suits. This means that extra garments must be carried to practices and extra wet garments must be carried back home. Increasing weight and drag by wearing additional garments can also have the disadvantage of distributing the added weight and drag unevenly on the swimmer which can increase the tendency for his body to roll or dip.

As an alternative to wearing extra garments during training, various mechanical attachments have been proposed for swimmers such as those shown in U.S. Pat. Nos. 3,142,485; 3,517,930 and 3,584,870. The devices disclosed in the first two patents are somewhat cumbersome and awkward and do not distribute the drag evenly over the swimmer's body. The pocket attachment disclosed in the third patent, which is the closest prior art known to the applicants, also fails to distribute the drag evenly and has the further disadvantage that it can slip out of position and throw the swimmer out of balance.

Along with U.S. Pat. No. 3,584,870, supra, the closest prior art known to the applicants is U.S. Pat. No. 4,071,236, granted Jan. 31, 1978 to George Oprean, one of the applicants herein. The Oprean patent discloses a swimmer's drag suit adapted to be worn over a regular tank suit and provided with a plurality of drag creating pockets on its front and back sides. The pockets on both sides of the suit are arranged so as to be symmetrical with the centerline of the suit whereby the drag forces are uniformly distributed over the swimmer's body and there is no imbalance.

SUMMARY OF THE INVENTION

The drag producing belt of the present invention is adapted to be worn with a snug fit around the swimmer's waist, the belt including means for adjustably securing its ends together. A plurality of drag creating pockets are secured to the belt and are arranged, in a preferred embodiment, so that there are two such pockets on the front of the swimmer and two on the back when the belt is being worn. Each pocket is normally open at one end and the pockets are disposed on the belt so that they act as scoops as the swimmer moves through the water. To this end, entry of the water into the pockets is aided by means which normally hold them in an open, uncollapsed condition.

The belt of the invention functions in substantially the same manner as the Oprean drag suit referred to above but it is somewhat easier and quicker to put on and take off. In addition, male swimmers who wear swim trunks prefer the belt to the suit.

DESCRIPTION OF THE PREFERRED EMBODIMENT

Figure 1:
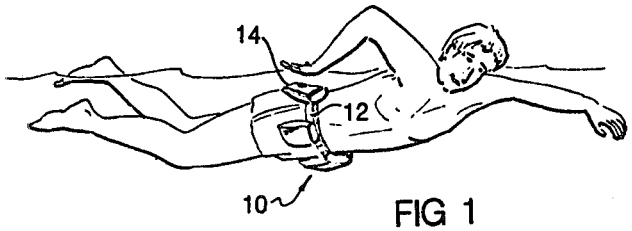
FIG. 1 is a view of a swimmer wearing the drag producing belt of the invention.
Figure 2:
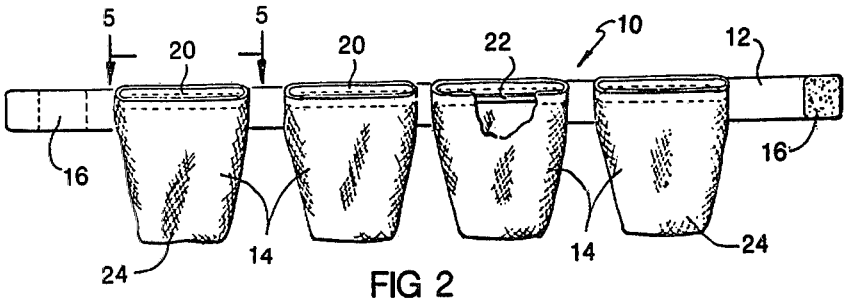
FIG. 2 is an elevation of the belt in opened out position.

Referring now to the drawings, 10 generally indicates the drag creating device of the invention which is essentially comprised of an elongated belt member 12 and a plurality of pockets 14 secured to the belt in a manner to be described. The belt 12 is preferably made of a fabric such as canvas and is provided at its opposite ends with an interengaging fastening material 16 available commercially under the trademark "VELCRO". The "VELCRO" fastening is sufficiently adjustable to enable the same belt to be worn by swimmers of several different waist sizes.

Figure 3:
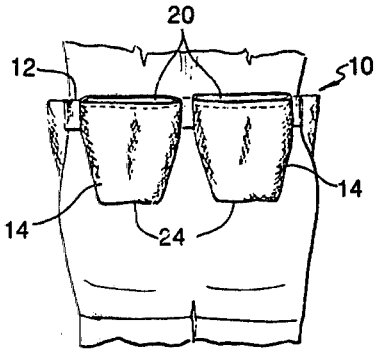
FIG. 3 is a view showing the belt on a swimmer, looking towards the swimmer's back.
Figure 4:
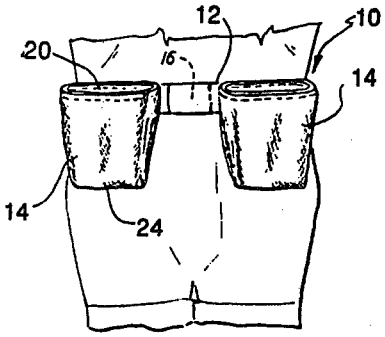
FIG. 4 is a view corresponding to FIG. 3 looking towards the front of the swimmer.
Figure 5:
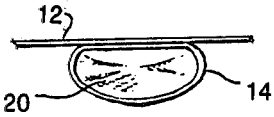
FIG. 5 is a top plan view of one of the drag creating pockets, the view being taken substantially on line 5—5 of FIG. 2.
Figure 6:
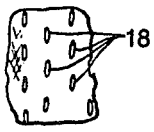
FIG. 6 is a fragmentary, detailed view showing a piece of the cloth from which the pockets are preferably made.

The pockets 14 are preferably made from a commercially available nylon tricot mesh cloth that has a multiplicity of small, uniformly spaced holes 18 as best shown in the FIG. 6 detail. Each pocket is a self contained, cup-like unit having an open upper end 20 as shown in FIGS. 2–5. In order to keep the upper ends of the pockets in an open, uncollapsed condition, the upper edge of each pocket may have incorporated therein a relatively stiff strip 22 of elastic material, see FIG. 2. From its open upper end, each pocket tapers down to a single, straight bottom edge 24 as best shown in FIGS. 4 and 5.

The pockets 14 are secured to the belt 12 by having a portion of the upper edge of each pocket, FIG. 5, sewn or otherwise securely fastened to the belt, the pockets being disposed so that the open ends thereof face in the direction of the swimmer's movement through the water regardless of whether he is swimming on his stomach or back. As indicated in FIGS. 3 and 4, the pockets are located on the belt so that when worn there are two pockets on the front and two on the back in a symmetrical arrangement. Such an arrangement causes the drag forces to be uniformly distributed over the swimmer's body as is desired.

As the swimmer moves through the water wearing the belt, the pockets 14 function as scoops and fill with water. The water can escape from the pockets through the fabric thereof and particularly through the holes 18 but since the water cannot escape from the pockets as fast as it enters them, drag is created. A funneling effect caused by the tapered construction of the pockets also helps to create the drag.

The elastic strip 22 that normally holds each pocket open will yield and permit the pocket to collapse if it is inadvertently hit by the swimmer's arm. Similarly, the pockets may discharge water on turns and then refill.

From the foregoing description it will be apparent that the invention provides a novel and very advantageous drag producing belt for swimmers training for competition. As will be apparent to those familiar with the art, the invention may be embodied in other specific forms without departing from the spirit or essential characteristics thereof.

We claim:

1. A drag creating device for a swimmer training for competition, the device being adapted to be worn around the swimmer's waist and comprising a belt member having adjustable means for securing its ends together, and a plurality of cup-like drag creating pockets, each having a front and a back, said pockets secured to the belt, the upper ends of said pockets being normally open, the pockets being made of cloth having a multiplicity of small openings therein, the upper edge of each pocket adjacent its open upper end having elastic, resilient means for normally holding the pocket in an open, uncollapsed condition, a portion of each said pocket upper edge being secured to the belt so that the pocket operates as a scoop when the swimmer moves through the water, the elastic, resilient means at the upper edge of each pocket permitting the pocket to collapse on turns or if hit by the swimmer's arm, the bottom edge of each pocket being closed, the pockets being arranged on the belt so that there is at least one pocket on the front and at least one pocket on the back of the swimmer.

2. A drag device as defined in claim 1 wherein there are a plurality of pockets on both the front and back of the swimmer, said pockets being symmetrically arranged.

3. A drag device as defined in claim 1 wherein the length of each pocket is substantially greater than the width of the belt member.

* * * * *